United States Patent [19]

Rasquin

[11] 3,949,154

[45] Apr. 6, 1976

[54] INTERNALLY COOLED HIGH-VOLTAGE HIGH-ENERGY CABLE

[75] Inventor: Werner Rasquin, Cologne, Germany

[73] Assignee: Felten & Guilleaume Kabelwerke AG, Cologne, Germany

[22] Filed: Apr. 4, 1974

[21] Appl. No.: 457,779

[30] Foreign Application Priority Data

Aug. 2, 1973 Germany ..... 2339102

[52] U.S. Cl. ..... 174/15 C; 174/106 R; 174/126 R

[51] Int. Cl.[2] ..... H01B 7/34

[58] Field of Search ..... 174/15 C, 15 R, 25, 126 R, 174/126 CD, 128, 130, 106 R, 107, 110 A

[56] References Cited

UNITED STATES PATENTS

| | | | |
|---|---|---|---|
| 873,216 | 12/1907 | Davis | 174/15 C |
| 2,969,415 | 1/1961 | Hartill et al. | 174/19 |
| 3,666,879 | 5/1972 | Hirsch | 174/130 X |

FOREIGN PATENTS OR APPLICATIONS

| | | | |
|---|---|---|---|
| 1,940,148 | 2/1971 | Germany | 174/15 C |
| 1,133,333 | 11/1968 | United Kingdom | 174/110 A |
| 404,245 | 1/1934 | United Kingdom | 174/15 C |
| 622,506 | 6/1961 | Canada | 174/15 C |
| 1,026,817 | 3/1958 | Germany | 174/130 |

OTHER PUBLICATIONS

Advantages of 400 kv Internally Oil-cooled Cable, Electric Times, Vol. 158, No. 12 Sept. 17, 1970, pp. 59–60.

*Primary Examiner*—Arthur T. Grimley
*Attorney, Agent, or Firm*—Michael J. Striker

[57] ABSTRACT

A cable for transmitting high electric energies comprises an inner tubular member which is provided with a channel for conducting a cooling medium, an outer tubular member surrounding the inner tubular member, a cable jacket surrounding the outer tubular member with spacing, and an insulation provided intermediate the outer tubular member and the cable jacket. The inner and outer tubular members are circumferentially complete so that the cooling medium cannot escape into the insulation and cause damage thereto. The inner tubular member may itself serve as an electric conductor, or a separate electric conductor may be situated intermediate the inner and the outer tubular members.

15 Claims, 2 Drawing Figures

INTERNALLY COOLED HIGH-VOLTAGE HIGH-ENERGY CABLE

BACKGROUND OF THE INVENTION

The present invention relates to an internally cooled cable for transmitting high electrical energies, and particularly to a high-voltage, high-energy cable comprising an electric conductor surrounding a channel for conducting a cooling medium, an outer tubular member surrounding the electric conductor, a cable jacket surrounding the outer tubular member and insulation intermediate the outer tubular member and the cable jacket and separating one from the other.

Internally cooled, particularly water cooled, high-energy cables are already known, for instance from the German published patent application No. 1,960,546 or from the publication Draht Coburg 21 (1970) No. 4, entitled "Wassergekuehltes Kabel fuer die CERN" (Water-cooled Cable for the CERN), pages 230 to 233. However, the cables disclosed in these publications are not suited for transmission of high electric energies in the region up to 2000 MVA. This can be easily established when the selected cable dimensions, such as the diameter of the electric conductor or the diameter of the cooling channel, are considered.

Furthermore, it is known, for instance from the U.S. Pat. No. 3,509,266, to provide a high-voltage cable with a high energy-transmitting capacity, which includes an electric conductor which is sealed and which is provided with an internal channel through which a cooling medium, such as water, is conducted. However, the electric conductor of this cable is not circumferentially complete but is rather provided with a fluid-impermeable layer on its outer surface in order to prevent the cooling medium from penetrating into the electric insulation. This patent also discloses that the transmission capacity of a cable can be substantially increased by internally cooling the same; however, no information is provided about the dimensioning of such water-cooled high-voltage cable and particularly about the dimensions of the electric conductor so as to minimize the expenses connected with such a cable, which expenses include the expenses of manufacturing and installing the cable and the operating expenses of the cable.

There is also already known, from a commonly assigned copending U.S. patent application Ser. No. 457,778, filed Apr. 4, 1974 to provide a high-energy, high-voltage cable comprising an inner tubular member defining a cooling channel for a cooling medium, the inner tubular member itself serving as, or being surrounded by, an electric conductor, an outer jacket surrounding the electric conductor, and an electric insulation intermediate the electric conductor and the cable jacket and electrically separating the former from the latter. It has been also disclosed in this application that best results are obtained when, in the case that the electric conductor is made of aluminum, the diameter of the channel provided in the inner tubular member is at least 60 mm, preferably equal to or exceeding 70 mm and, in the event that the electric conductor is made of copper, the inner diameter of the channel is at least 70 mm, preferably equal to or exceeding 80 mm. When such dimensions of the channel are selected, it is assured that the expenses connected with the production and the maintenance of the cable are minimized. In other words, the overall expenses, which are obtained by adding the cost of installing the cable to the cost of maintaining the cable and to the cost of electric losses occurring during the operation of the cable are at their optimum, while any deviation from the above-mentioned values of the dimensions of the cable results either in a substantial increase in the cost of production and installation of the cable with a small reduction in the amount of losses or in a significant increase in the amount of losses and the cost of maintaining the cable with a disproportionately small decrease in the production and installation costs so that, when these costs are added, the result is a higher overall expense than that obtained when the dimensions are such as proposed by the present invention. The above-mentioned expenses may be even further reduced with a simultaneous increase in the transmitted electric energy when the thickness of the wall of the electric conductor amounts to substantially 15 mm when aluminum is used for the electric conductor, resulting in a conducting cross-section of at least 3200 $mm^2$ while, when copper is used for the electric conductor, the advantageous results are obtained when the wall thickness of the electric conductor amounts to substantially 12.5 mm and the conductive cross-section of the electric conductor amounts to at least 3000 $mm^2$.

Experience has shown that such a cable works satisfactorily under ordinary circumstances; however, it has also been established that there exists the danger that the inner tubular member which defines the cooling channel may develop cracks or fissures permitting penetration of the cooling medium through the inner tubular member and through the electric conductor into the electric insulation, or that the fluid-tightness of the cable may deteriorate in any other way, so that the cooling medium will be permitted to reach and enter into the electric insulation. Once the cooling medium enters the electric insulation, the result is not just a temporary disruption of the function of the cable which would require only the location of the break or fissure and repair of the affected portion after which the cable could be put back into operation, but rather the electric insulation, which may consist of several layers of oilpaper or similar insulating material, suffers permanent damage which renders the entire cable, or a section thereof, provided that the various sections are sealed with respect to one another, unusable.

SUMMARY OF THE INVENTION

It is an object of the present invention to provide a water-cooled high-voltage cable which avoids the disadvantages of the prior art.

It is another object of the present invention to provide an electric cable which is relatively inexpensive to produce and easy to install.

It is still another object of the present invention to provide a water-cooled cable which renders possible the transmission of high electric energies in the order of 2000 MVA.

It is yet another object of the present invention to provide a cable which minimizes the overall costs connected with providing and operating the cable irrespective of the length thereof and of the energy transmitted by the cable.

It is a further object of the present invention to provide a cable in which penetration of the cooling medium into the electric insulation is effectively prevented.

It is a concomitant object of the present invention to provide a cable in which the development of fissures in the tubular member defining the cooling channel can be timely detected and removed.

In pursuance of these objects and others which will become apparent hereafter, one feature of the present invention resides in the provision of an inner tubular member which defines a channel for a cooling medium such as water, an outer tubular member surrounding the inner tubular member, a cable jacket surrounding the outer tubular member, and an electric insulation provided intermediate the outer tubular member and the cable jacket. In the currently preferred embodiment of the invention, the inner tubular member may be of lead or aluminum, and an electric conductor made of aluminum is provided intermediate the inner and the outer tubular members. Advantageously, the outer tubular member is an aluminum tube pressed on the electric conductor, which may comprise several strands of aluminum conducting members.

When the high-voltage high-energy cable is constructed in accordance with the currently preferred embodiment of the present invention as described above, and when fissures or other breaks develop, permitting passage of the cooling medium through the inner tubular member, the outer tubular member which is intact prevents the cooling medium from penetrating into the electric insulation and from damaging the same. The cooling medium which has passed into the space between the inner and the outer tubular member which is, in the currently preferred embodiment, almost entirely filled with the sealed strands of the electric conductor, will eventually find its way through the gaps between the various strands and will reach one of the ends of the cable. Even though the flow through these gaps is very limited, some of the cooling medium will after a certain period of time appear at the end portions of the cable, thus indicating to the person in charge of the maintenance of the cable that a break or a fissure has developed in the inner tubular member of the cable permitting the cooling medium to penetrate into the space between the inner and outer tubular members. However, since the development of such fissures is not necessarily detrimental to the function of the cable, and since the fact of leakage is determined soon enough, that is before any permanent damage to the cable has occurred, and particularly without any damage to the electric insulation, the cable may be put out of operation and the location of the leak may be determined and the fissure causing the leakage may be easily removed. This means that only the effected section of the cable has to be repaired, without rendering the entire cable unusable.

A further advantage is obtained when the outer tubular member is pressed on the electric conductor in accordance with the invention, namely the fact that the sealing of the strands of the electric conductor may be accomplished without exercising extraordinary care since the outer tubular member has a smooth outer surface facing the electric insulation, which gives the cable core comprising the inner tubular member, the electric conductor and the outer tubular member a smooth surface in contact with the electric insulation, so that the latter will not be damaged by any sharp edges or projections which may be present on the outer surface of the sealed electric conductor; rather, the sharp edges which may be the result of various manufacturing processes, including the sealing process, are separated from the electric insulation by the outer tubular member.

In view of the fact that the high-voltage high-energy cable according to the invention has to have the same advantageous properties as the heretofore known cables, especially that the cable must be sufficiently flexible in order to permit its storage and transportation on reels or drums, without adversely effecting the cross-section and the electric resistance of the electric conductor to the flow of electrical current therethrough, it is a further feature of the present invention to form the electric conductor as a metallic inner tubular member provided with the cooling channel therein, the inner tubular member preventing escape of the cooling medium out of the cooling channel.

When it is desired to obtain an even more pronounced increase in the energy transmitted by the cable according to the invention, it is necessary to improve the current-conducting properties of the cable. One of the possibilities of increasing this capacity of the electric conductor to transmit electric current resides in increasing the cross-section of the electric conductor. However, since it is impossible to increase the cross-section of the electric conductor ad infinitum, especially when the electric conductor is formed as an inner tubular member, it is proposed in a currently preferred embodiment of the invention to form the electric conductor of the high-voltage high-energy cable as a smooth metallic inner tubular member which surrounds and defines the channel therein, the inner tubular member being surrounded by an outer tubular member, a plurality of electric conductor elements or strands serving the purpose of conducting the electric current therethrough being arranged intermediate the inner and the outer tubular members in form of segments and/or in a plurality of layers. When the cable is formed in the above-described manner, the following advantages are achieved: the cross-section of the electric conductor remains unchanged even when the cable is subjected to very high flexing stresses, the cross-sectional area of the electric conductor is relatively large while the skin effect is to a large degree avoided, the surface pressure in the region of contact of the outer tubular member with the electric insulation is significantly reduced, the electric conductor has a high coefficient of filling or space utilization, and it has a relatively large outer surface in contact with the outer tubular member and, therefore, a good coefficient of thermal conduction outwardly of the electric conductor through the outer tubular member.

Experience has shown that in a tubular conducting member, such as that provided according to the invention, it is undesirable to make the thickness of the wall of such a tubular conducting member substantially greater than the equivalent conductor thickness of the material of the conductor. The thickness $\delta$ of the wall of the electric conductor may be calculated from the following equation:

$$\delta = \sqrt{\frac{\rho}{\mu \cdot f \cdot \pi}},$$

wherein $\rho$ is the specific electric resistance, $f$ is the frequency of the alternating current, and $\mu$ is the permeability of the material of the conductor.

In view of the fact that the specific resistance of the electric conductor increases with the increasing temperature, it may be concluded from the above equation that the equivalent thickness of the conducting wall of the electric conductor has to increase with increasing temperature. Therefore, it is proposed in a further embodiment of the cable according to the invention that the wall thickness of the electric conductor increase in proportion to the increasing length of the installed cable with attendant increase of the specific resistance of the electric conductor. This preferred embodiment is based on the observation that the temperature and the specific resistance of the electric conductor of the cables with interior cooling of the conductor increases with the increasing distance from the point at which the cooling medium is introduced into the cooling channel, so that the equivalent wall thickness also increases in proportion to this increase in the specific resistance. It has been found to be advantageous with this embodiment to assemble the cable from consecutive sections, and to increase the thickness of the electric conductor in incremental steps from one section of the cable to the next consecutive section downstream of the first-mentioned section when viewed in the direction of flow of the cooling medium, so that a cable is obtained which includes a plurality of cable sections in which the thickness of the electric conductor increases from one section to the next consecutive one as a function of the distance of the section from the point at which the cooling medium is introduced into the cooling channel and thus as a function of the temperature and specific resistance of the electric conductor.

It has been established that a higher amount of electric energy can be transmitted through the cable according to the invention when the temperature of electric conductor is allowed to exceed the limiting temperature which is determined by the insulating properties of the electric insulation. The advantage obtained by this arrangement is to be seen in the fact that under such circumstances it is possible to utilize the entire cooling capacity of the cooling medium, such as cooling water, letting the temperature thereof increase just slightly below the boiling temperature. This can be achieved according to a further currently preferred embodiment of the invention without inflicting any damage to the electric insulation by providing a layer of a material having a high thermal resistance adjacent the outer surface of the outer tubular member prior to the application of the electric insulation thereto. This layer which is immediately adjacent to the outer tubular member serves the purpose of reducing the amount of heat penetrating therethrough so that the temperature at the outer surface of such layer is reduced to a temperature slightly below what the material of the electric insulation can withstand. According to another embodiment of the invention, it is also advantageous to provide the cable jacket with a similar layer of a material with high thermal resistance so that, while the bulk of the heat which is generated in the electric conductor by passage of the current therethrough is transmitted to the cooling medium and conducted thereby out of the conductor and out of the cable, the remaining heat which is allowed to penetrate through the electric insulation and to reach the cable jacket is mainly conducted through the jacket axially thereof while only a small portion thereof will be permitted to penetrate through the layer of the material with low thermal conductivity so that it is, for instance, possible to reduce the temperature of the upper or outward surface of a cable which is situated below the surface of the ground below 40°C so that detrimental effects to the environment are avoided.

Since the high-voltage high-energy cable according to the invention comprises an electric conductor having a very large cross-section, the weight per unit of length of such a cable is considerable. Consequently, it would be advantageous to manufacture such a cable from aluminum which has low specific weight. However, one of the disadvantageous properties of aluminum is that it is attacked and caused to corrode by various media, including the cooling water is such is used for cooling the cable. Evidently, it is necessary to make the surface of the aluminum conductor which comes into contact with the cooling medium resistant to the influence of the cooling medium. Thus, it is proposed in a further embodiment of the cable according to the invention to provide the inner surface of the tubular aluminum conductor which bounds the channel with a protective coating which may be formed by a copper tube located adjacent to such surface, by a tubular member of synthetic plastic material separating the cooling medium from the inner surface of the electric conductor or by providing a metallic oxide layer on such an inner surface. It has also been found to be advantageous, when the tubular member is not needed for conducting the electric current, to make it in its entirety from a synthetic plastic material.

On the other hand, when the weight of the cable is unimportant, it is advantageous to make the inner tubular member of lead. The advantages obtained by this measure include the fact that the inner tubular member which defines the channel for the flow of the cooling medium has a high degree of resistance to the chemical properties of the cooling water, when such is used, to cause corrosion of the inner tubular member if such were made of other metallic materials. Another advantage obtained when the inner tubular member is made of lead is that it has a high degree of flexibility without development of bulges or undulations, which results in the possibility to make the wall of the inner tubular member relatively thin with attendant increases in the dimensions of the cooling channel when the outer diameter of the inner tubular member is predetermined. A further advantage of the inner tubular member made of lead is that it readily yields when subjected to pressure, so that the process of assembling the cable from various sections is simplified. Also, the forces resulting from the heating and the cooling of the cable and acting in the longitudinal direction thereof are sufficiently small to compensate therefor in the connections of the various sections together forming the cable. Furthermore, since lead has approximately the same coefficient of thermal expansion as aluminum, only minute additional longitudinal stresses result from the fact that the materials of the inner tubular member and of the electric conductor are different.

In a further embodiment of the cable according to the invention, the electric insulation is formed by oilpaper. Depending on the kind of the electric insulation, various construction of the cable jacket can be used. So, for instance, when the cable is of the kind in which gaseous medium at superatmospheric pressure is utilized within the jacket, the latter is constituted by a pressure resistant flexible tube; when the cable is of the kind in which pressure of a gaseous medium is applied outwardly, the cable jacket is made of elastic material which separates the pressurized gaseous medium from the electric insulation, and the separate cable strands are pulled into pressure resistant tubes; when the cable is a low-pressure or high-pressure oil cable, then the jacket is provided with a sufficiently large conduit for the oil, since the delivery of the oil to the electric insulation cannot be accomplished through the electric conductor, such as a corrugated aluminum tube. When the cable is of the type using oil at a static pressure, then the jacket is a pressure resistant tube into which the various strands of the electric conductor are pulled at the location where the cable is being installed, the strands being of a three conductor construction and without separate jackets; also a flexible corrugated aluminum tube can be utilized for the cable jacket.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
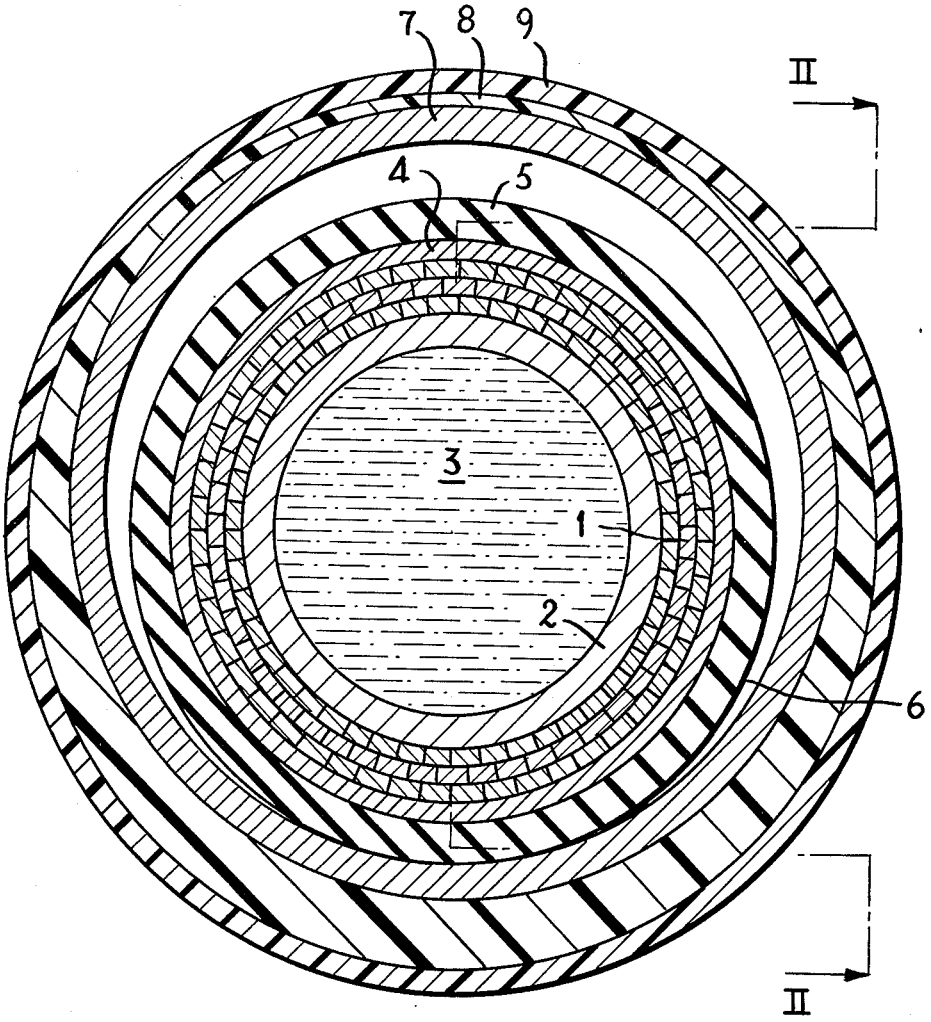
FIG. 1 is a cross-sectional view of a currently preferred embodiment of the cable according to the invention.

The high-voltage high-energy cable according to the invention comprises an electric conductor 1 which is composed, in the currently preferred and illustrated example of the embodiment of the invention, of sealed aluminum strands which are arranged in three layers. An inner tubular member 2 made of aluminum or lead is situated inwardly from the electric conductor 1, being surrounded thereby, and defines a hollow channel serving the purpose of conducting a cooling medium 3, such as water. An outer tubular member 4 made of aluminum is pressed upon the electric conductor 1 and surrounds the same, and is, in turn, surrounded by an electric insulation 5. The electric insulation 5 may be, for instance, made of oilpaper. The inner tubular member 2, the electric conductor 1, the outer tubular member 4, and the electric insulation 5 together constitute a cable core which is surrounded by an electric shielding 6 and is pulled into a corrugated tube 7 which may be made, for instance, of aluminum. The outer surface of the corrugated aluminum tube 7 is provided with a layer 8 of synthetic plastic material and a polyvinylchloride jacket 9 in order to prevent corrosion and/or mechanical damage to the outer surface of the tube 7.

The inner tubular member 2 which serves the purpose of conducting the cooling medium 3, such as water, has an inner surface which is preferably substantially smooth in order to afford the channel advantageous flow characteristic. Such advantageous characteristic may be obtained by providing the inner surface with certain corrugations, but it also can be achieved by providing the inner surface of the inner tubular member 2 with an additional tube which is pulled into the inner tubular member 2 and is located adjacent to the inner surface thereof, separating the same from the cooling medium. The tubular member 2 preferably has a relatively large inner diameter and, when the various layers which surround the inner tubular member 2 are incapable of withstanding the pressure of the cooling medium, the tubular member 2 should itself be sufficiently rigid to withstand such pressure. This is particularly true when the inner tubular member 2 is of lead. Additional requirements for the inner tubular member 2 are that it has a high thermal conductivity, that the thermal resistance thereof be minute when compared to the thermal resistance of the various components or layers surrounding the outer tubular member 4 and also when compared with the thermal resistance of the ground in case that the cable is to be situated below the surface thereof. With respect to the construction and the arrangement of the electric conductor 1, it is to be said that it preferably has a large conductive cross-section so that it permits transmission of highest possible transmission currents therethrough. In the currently preferred embodiment of the invention, the electric conductor 1 is made of aluminum, the wall thickness thereof being substantially 15 mm and the conductive cross-section being at least 3200 $mm^2$. Furthermore, the electric conductor 1 is preferably located immediately adjacent to the tubular member 2 which conducts the cooling medium 3 so as to facilitate thermal heat conduction into and through the tubular member 2 and into the cooling medium 3, and it also is of a very compact construction with a high degree of space filling so as to render possible keeping the outer diameter of the electric conductor 1 and the overall dimensions of the cable to a minimum. In addition thereto, the electric conductor 1 preferably has advantageous electrical properties, particularly low losses due to alternating current loss effects, such as skin effect. When the electric insulation 5 consists of oil saturated paper windings, the electric shielding 6 comprises at least one layer of shielding papers which may also be surrounded by copper bands. If so desired, copper bands may be provided at least partially surrounding the electric shielding 6. The corrugated aluminum tube 7 can have either helical or annular corrugations.

Figure 2:
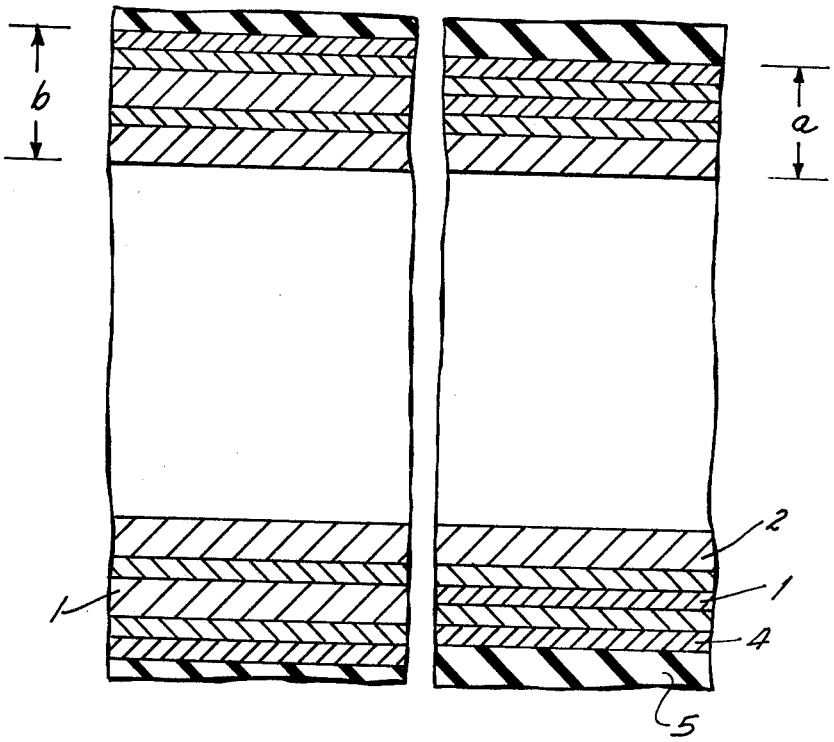
FIG. 2 is a partial sectional view of two adjacent sections of the cable taken on line II—II of FIG. 1.

FIG. 2 illustrates that the thickness of the electric conductor may increase, for reasons explained previously, from one section of the cable to the adjacent section, from *a* to *b*.

It will be understood that each of the elements described above, or two or more together, may also find a useful application in other types of high-voltage high-energy cables differing from the types described above.

While the invention has been illustrated and described as embodied in a high-voltage high-energy cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A water-cooled high-energy cable, comprising electrically conductive means including an impermeable elongated inner tubular member of a metallic material having a smooth inner surface circumferentially defining a cooling channel having a diameter of at least 60 millimeters for the cooling water, and an outer surface, and a plurality of conductor elements of aluminum arranged about said outer surface of said inner tubular member; an outer tubular member of aluminum pressed on said conductor elements; electrically insulating means surrounding said outer tubular member; and a cable jacket surrounding said electrically insulating means.

2. A cable as defined in claim 1, wherein said inner tubular member is of aluminum.

3. A cable as defined in claim 2, and further comprising an oxidized layer on said inner surface.

4. A cable as defined in claim 1, wherein said inner tubular member is of lead.

5. A cable as defined in claim 1, wherein said conductor elements are arranged in segments.

6. A cable as defined in claim 1, wherein said conductor elements are arranged in several layers.

7. A cable as defined in claim 1, wherein said outer tubular member has an outer surface; and further comprising a layer of a material of high thermal resistance applied to said outer surface.

8. A cable as defined in claim 1, wherein said cable jacket has an exposed surface; and further comprising a layer of a material of high thermal resistance applied to said exposed surface.

9. A cable as defined in claim 1, and further comprising an additional tubular member adjacent to said inner surface and separating the cooling medium from the latter.

10. A cable as defined in claim 9, wherein said additional tubular member is of copper.

11. A cable as defined in claim 9, wherein said additional tubular member is of synthetic plastic material.

12. A cable as defined in claim 1, wherein said insulation means comprises at least one layer of oilpaper.

13. A cable as defined in claim 1, wherein said electric conductor has a circumferential wall having a thickness of substantially 15 mm; and wherein the conducting cross-section of said electric conductor is at least 3200 $mm^2$.

14. An internally cooled high-energy cable, comprising a circumferentially complete elongated inner tubular member provided with at least one cooling channel for the flow of a cooling medium; an outer tubular member surrounding said inner tubular member; an electric conductor intermediate said inner and outer tubular members and having a thickness; a cable jacket surrounding said outer tubular member and defining a clearance therewith; and electric insulation means in said clearance and separating said cable jacket from said outer tubular member; and wherein said thickness increases with increasing length of the cable as a function of the increase in the specific resistance of said electric conductor.

15. A cable as defined in claim 14, wherein said cable comprises a plurality of sections; and wherein said thickness of said electric conductor of one of said sections exceeds said thickness of said electric conductor of an other of said sections.

* * * * *